US011365707B2

(12) United States Patent
Atkins et al.

(10) Patent No.: US 11,365,707 B2
(45) Date of Patent: Jun. 21, 2022

(54) INJECTOR

(71) Applicant: Dolphin N2 Limited, Shoreham-By-Sea (GB)

(72) Inventors: Andrew Atkins, Shoreham By Sea (GB); Robert Morgan, Shoreham By Sea (GB); Rhys Pickett, Shoreham By Sea (GB)

(73) Assignee: Dolphin N2 Limited

( * ) Notice: Subject to any disclaimer, the term of this patent is extended or adjusted under 35 U.S.C. 154(b) by 180 days.

(21) Appl. No.: 16/626,204

(22) PCT Filed: Jun. 27, 2018

(86) PCT No.: PCT/GB2018/051793
§ 371 (c)(1),
(2) Date: Dec. 23, 2019

(87) PCT Pub. No.: WO2019/002854
PCT Pub. Date: Jan. 3, 2019

(65) Prior Publication Data

US 2020/0124003 A1 Apr. 23, 2020

(30) Foreign Application Priority Data

Jun. 30, 2017 (GB) ..... 1710521

(51) Int. Cl.
*F02D 1/06* (2006.01)
*F02M 21/02* (2006.01)
(Continued)

(52) U.S. Cl.
CPC ..... *F02M 21/0248* (2013.01); *F01P 9/02* (2013.01); *F02B 47/04* (2013.01); *F02M 25/025* (2013.01);
(Continued)

(58) Field of Classification Search
CPC ..... F02M 25/03; F02M 61/08; F02B 47/02; F02B 47/04; F02B 29/0443
(Continued)

(56) References Cited

U.S. PATENT DOCUMENTS 5,076,244 A 12/1991 Donaldson
5,375,580 A 12/1994 Stolz et al.
(Continued)

FOREIGN PATENT DOCUMENTS

JP H08177591 A 7/1996
WO 2012000039 A1 1/2012
(Continued)

OTHER PUBLICATIONS

International Search Report from PCT/GB2018/051793, dated Sep. 24, 2018, pp. 1-3.
(Continued)

*Primary Examiner* — Long T Tran
*Assistant Examiner* — James J Kim
(74) *Attorney, Agent, or Firm* — Lerner, David, Littenberg, Krumholz & Mentlik, LLP

(57) ABSTRACT

A liquid coolant injector for injecting a liquid coolant into a cylinder of a split cycle engine, wherein the liquid coolant has been condensed into a liquid phase via a refrigeration process, the injector comprising, a thermally insulating housing, a liquid coolant inlet, a liquid coolant outlet in fluid communication with the liquid coolant inlet via a liquid coolant flow path wherein the liquid coolant flow path extends through the thermally insulating housing, the thermally insulating housing configured to inhibit vaporisation of the liquid coolant within the liquid coolant flow path, a valve closure member, moveable between a first position in which the valve closure member blocks the liquid coolant flow path and a second position in which the liquid coolant
(Continued)

may flow from the liquid coolant inlet to the liquid coolant outlet, and, a driver operable to move the valve closure member between the first and second position in response to a control signal.

18 Claims, 7 Drawing Sheets

(51) Int. Cl.

| | |
|---|---|
| ***F01P 9/02*** | (2006.01) |
| ***F02B 47/04*** | (2006.01) |
| ***F02M 25/022*** | (2006.01) |
| ***F02M 25/025*** | (2006.01) |
| ***F02M 53/04*** | (2006.01) |

(52) U.S. Cl.
CPC ..... *F02M 25/0222* (2013.01); *F02M 53/046* (2013.01)

(58) Field of Classification Search
USPC ..... 239/5
See application file for complete search history.

(56) References Cited

U.S. PATENT DOCUMENTS

| | | | | |
|---|---|---|---|---|
| 6,978,942 | B2 * | 12/2005 | Murdoch | F23D 11/34 239/8 |
| 10,240,520 | B2 * | 3/2019 | Jackson | F02B 33/22 |
| 2005/0071098 | A1 | 3/2005 | Iannone et al. | |
| 2010/0236526 | A1 * | 9/2010 | Wang | F02M 51/0671 123/456 |
| 2012/0031371 | A1 | 2/2012 | Sabathil | |
| 2013/0193239 | A1 * | 8/2013 | Del Frate | F02M 61/12 239/585.5 |
| 2014/0021272 | A1 | 1/2014 | Ryan et al. | |
| 2014/0046619 | A1 | 2/2014 | Heinrich | |
| 2018/0328304 | A1 * | 11/2018 | Pursifull | F02D 41/3854 |
| 2018/0328326 | A1 * | 11/2018 | Pfefferle | F02D 19/027 |
| 2020/0049058 | A1 * | 2/2020 | Atkins | F02B 29/0481 |

FOREIGN PATENT DOCUMENTS

| | | | |
|---|---|---|---|
| WO | 2016016664 | A1 | 2/2016 |
| WO | 2016120598 | A1 | 8/2016 |
| WO | 2017089229 | A1 | 6/2017 |

OTHER PUBLICATIONS

Search Report from GB1710521.4 dated Aug. 10, 2017, pp. 1-2.
Search Report from GB1914010.2 dated Oct. 11, 2019, pp. 1-2.
Search Report from GB1914011.0 dated Oct. 14, 2019, pp. 1-2.

* cited by examiner

INJECTOR

CROSS REFERENCE TO RELATED APPLICATIONS

The present application is a national phase entry under 35 U.S.C. § 371 of International Application No. PCT/GB2018/051793, filed Jun. 27, 2018, published in English, which claims priority from Great Britain Patent Application No. 1710521.4, filed Jun. 30, 2017, the disclosures of which are incorporated by reference herein.

FIELD OF THE INVENTION

The invention relates to the field of liquid injectors, for example liquid injectors for injecting liquids into a cylinder of an engine such as a split-cycle internal combustion engine.

INTRODUCTION

Conventional internal combustion assemblies may include multiple liquid injectors, each being configured to inject a liquid into a cylinder of the engine. In split cycle internal combustion engines, water may be injected into a compression cylinder to act as a coolant during the compression stroke. Such injectors are typically connected to a water reservoir so that water may be transferred from the reservoir to the injector where it is injected, typically in the form of droplets, into the compression cylinder. The droplets of water may then absorb some of the energy generated by the compression stroke as their temperature increases and boiling occurs.

SUMMARY OF THE INVENTION

Aspects of the invention are as set out in the independent claims and optional features are set out in the dependent claims. Aspects of the invention may be provided in conjunction with each other and features of one aspect may be applied to other aspects.

FIGURES

Embodiments of the invention will now be described, by way of example only, with reference to the drawings, in which.

SPECIFIC DESCRIPTION

Figure 1:
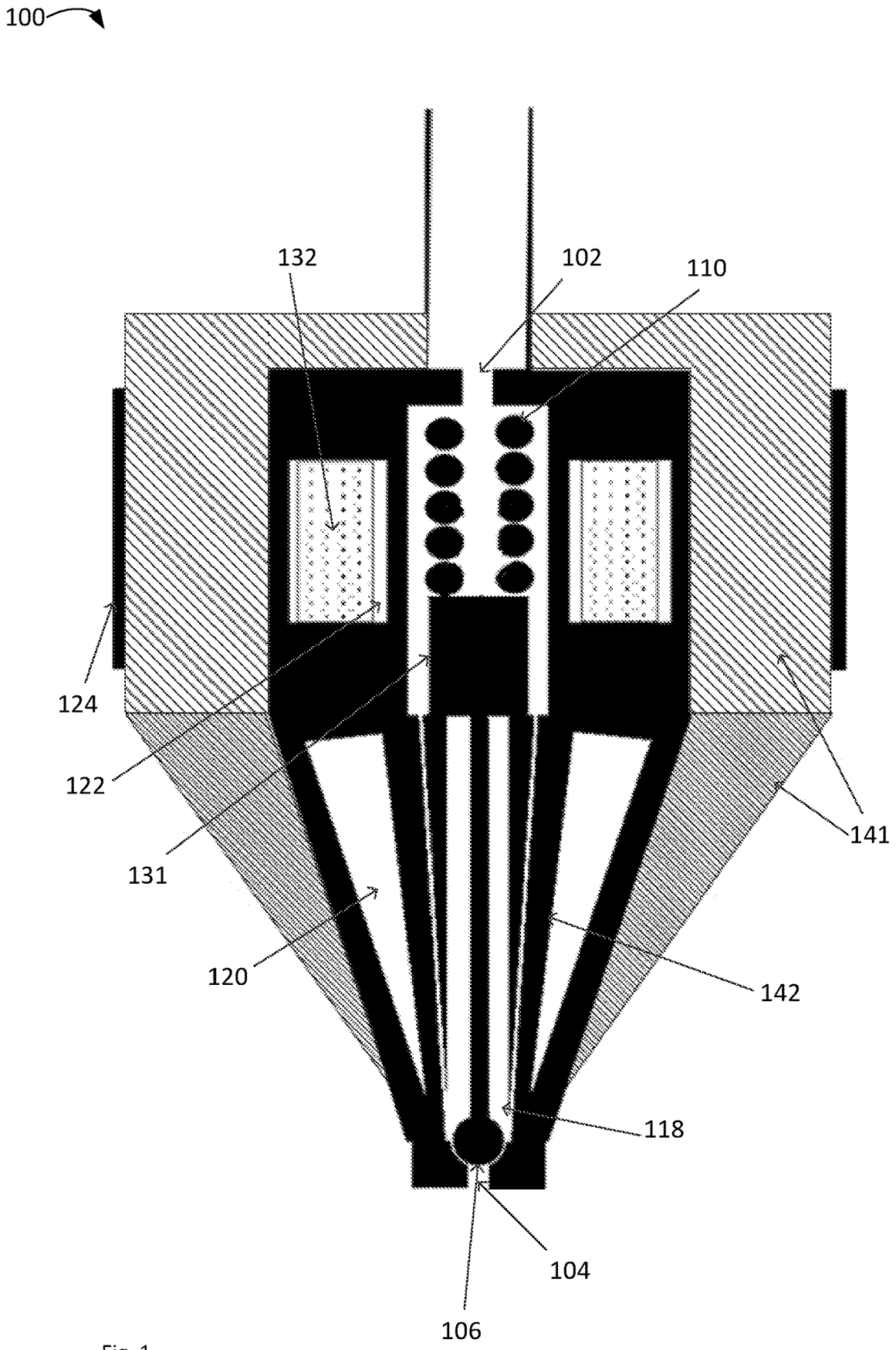
FIG. 1 shows a cross section of an example first liquid coolant injector in a first state.

FIG. 1 shows a cross section of liquid coolant injector 100 for injecting a liquid coolant into a cylinder such as the compression cylinder of a split cycle internal combustion engine, wherein the liquid coolant has been condensed into a liquid phase via a refrigeration process. The injector 100 includes a liquid coolant inlet 102, a liquid coolant outlet 104, a valve closure member 106, a driver 130 and a thermally insulating housing 140. The driver 130 comprises two parts: a moving part 131 and an actuating part 132. The thermally insulating housing 140 comprises two parts: an outer part 141 and an inner part 142. The liquid coolant outlet 104 may be coupled to a compression cylinder of a split cycle engine and the valve closure member 106 can be moved between a first and a second position. The valve closure member 106 blocks the liquid coolant flow path 118 in the first position and allows the liquid coolant to flow from the liquid coolant inlet 102 to the liquid coolant outlet 104 when in the second position. The driver 130 can move the valve closure member 106 between the first and second position in response to a control signal.

It should be understood that many components of the injector can vary between specific embodiments and that these variations in each component may be combined with any other variation of a separate component.

FIG. 1 shows a cross section of an example liquid coolant injector 100 for a split cycle engine comprising a liquid coolant inlet 102 and outlet 104. The liquid coolant outlet 104 may be coupled to a compression cylinder of a split cycle engine. In the embodiment of FIG. 1, the valve closure member 106 further comprises a shaft portion with two ends, wherein one end is in contact with the insulating housing surrounding the liquid coolant outlet 104 and the other end is mechanically connected to one end of the moving part 131 of the driver 130, wherein this part comprises a magnet. The other end of the moving part 131 of the driver 130 is in contact with one end of a spring 110, with the other end of the spring in contact with the inner part 142 of thermally insulating housing 140 surrounding the liquid coolant inlet 102.

The thermally insulating housing 140 is rigid and composed of two sections, an injector body forming the inner part 142 and an outer layer of insulation disposed on the outer surface of the rigid housing forming the outer part 141. The outer part 141 of the thermally insulating housing 140 encompasses all but a tip of the injector, wherein the tip is the section of the rigid housing surrounding the liquid coolant outlet 104. Within the rigid housing is the actuating part 132 of the driver 130, which comprises coils of copper in an epoxy resin matrix. These coils surround the fluid flow path between the liquid coolant inlet 102 and the liquid coolant outlet 104. Additionally, there are insulating voids 120 in the injector body between the liquid coolant outlet 104 and the moving part 131 of the driver 130. On the outside of the thermally insulating housing 140 is a magnetic shield 124. This surrounds the thermally insulating housing 140 in a band of material disposed radially outside the copper coils of the driver 130.

The injector 100 has a longitudinal axis defined by the liquid coolant flow path 118 and is largely symmetrical about this axis. The valve closure member 106 is disposed along this longitudinal axis within the liquid coolant flow path 118. A bottom portion of the injector is defined along the length of the valve closure member 106, wherein the bottom portion is cone-shaped with its smallest radius being proximal to the liquid coolant outlet 104 and the largest radius where the valve closure member 106 is connected to the moving part 131 of the driver 130. Each of the outer layer 141 and the inner layer 142 of the thermally insulating housing 140 and the insulating voids 120 follow the cone-shaped structure of the injector. The insulating voids 120 are disposed radially outward from the liquid coolant flow path and extend along the majority of the length of the valve closure member 106. The insulating voids 120 form a conical annulus which is thicker at the end proximal to the moving part 131 of the driver 130. The insulating voids 120 may extend through 360° to form one conical annulus, or they may be separated into a plurality of portions. The outer layer 141 of the thermally insulating housing 140 is disposed radially outwardly from the injector body.

A top portion of the injector 100 is defined above the bottom portion of the injector, wherein the top portion is largely cylindrical. The top portion extends along a length of the injector from the position where the valve closure member 106 is connected to the moving part 131 of the driver 130 to the liquid coolant inlet 102. The liquid coolant flow path 118, the moving part 131 of the driver 130 and a biasing member 110 are the radially innermost parts of the top portion. The injector body of the inner part 141 of the thermally insulating housing 142 is disposed radially outwards from the liquid coolant flow path 118. The injector body comprises a coil void in which the actuating part 132 of the driver 130 is disposed. The coil void may be larger than the actuating part 132 so that there is an unoccupied portion of the coil void radially inside and/or outside of the actuating part 132 of the driver 130. The injector body is disposed radially within the outer part 142 of the thermally insulating housing 140, and along at least the length of the coils of copper, the magnetic shield 124 is disposed radially outwardly from the outer part 141 of the thermally insulating housing 140.

Figure 2:
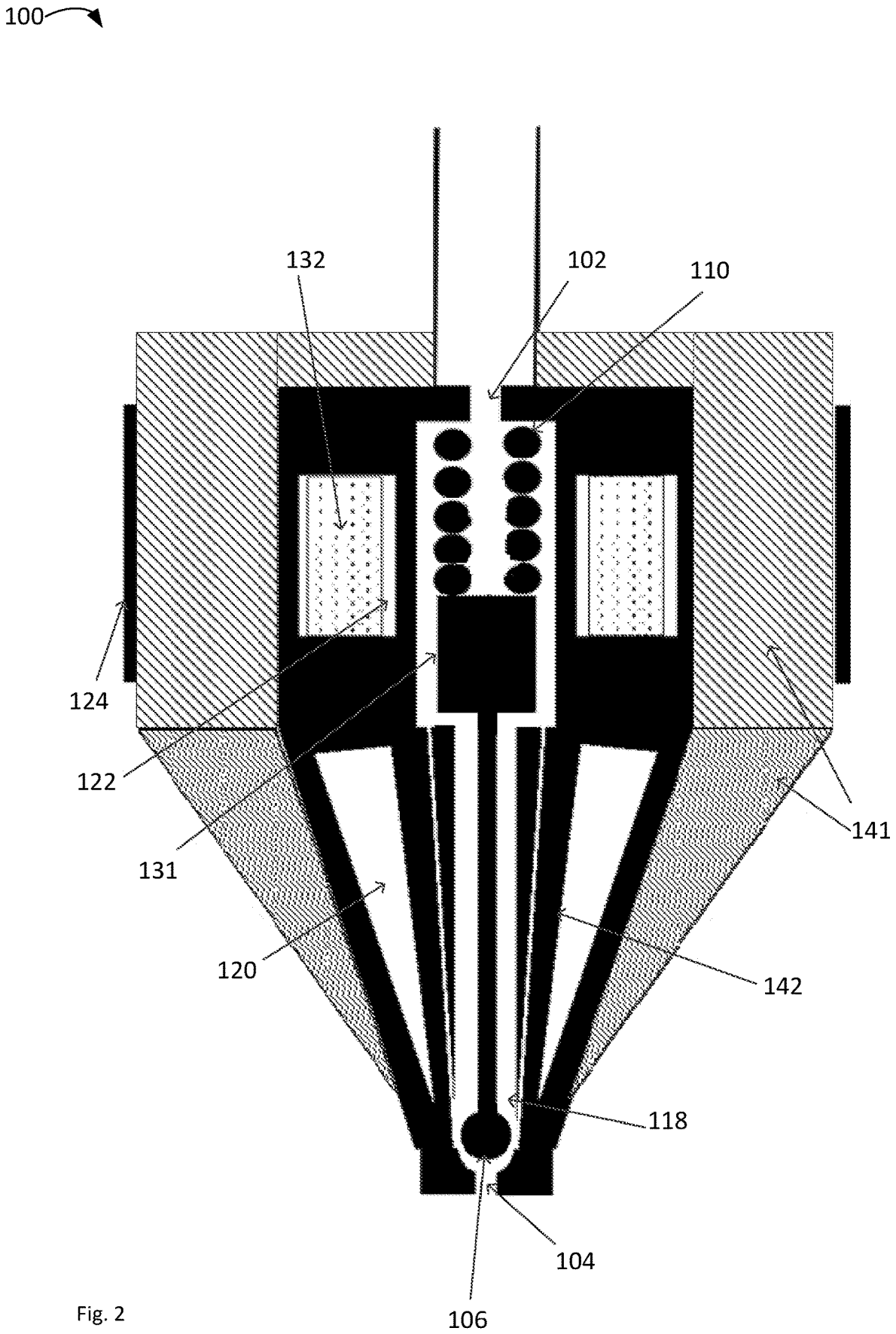
FIG. 2 shows a cross section of the example first liquid coolant injector of FIG. 1 in a second state.

The liquid coolant injector 100 is operable to inject liquid coolant into the compression cylinder of a split cycle engine in response to a control signal. In the embodiment of FIG. 1, the valve closure member 106 can be controlled such that it moves between a first position and a second position. The second position is depicted in FIG. 2 and is achieved by providing the biasing member 110, which is a spring 110 in the embodiment of FIGS. 1 and 2. The biasing member 110 biases the valve closure member 106 towards the first position by ensuring a contact between the valve closure member 106 and the thermally insulating housing 140 that surrounds the liquid coolant outlet 104. This biasing causes a seal at the liquid coolant outlet 104, preventing the flow of liquid coolant through the liquid coolant outlet 104.

The magnet of the moving part 131 of the driver 130 is mechanically coupled to the valve closure member 106 such that any force exerted on the magnet is transferred to the valve closure member 106. The positioning of the moving part 131 of the driver 130 in the first position depicted in FIG. 1 is such that the magnet is offset from the coils. This enables the copper coils to be controlled such that the magnet moves to the lowest energy position, leading to movement of the valve closure member 106. Once moved into the second position, which may be any position away from the first position, the valve closure member 106 is no longer in contact with the insulating housing surrounding the liquid coolant outlet 104 and liquid coolant can flow out of the liquid coolant injector.

The copper coils are operable by a controller by application of a current or potential difference. This current will generate a magnetic field due to the coiled state of the copper which interacts with the permanent magnet of the moving part 131 of the driver 130 within the injector 100. The copper coils are embedded in an epoxy resin. This prevents variations in expansion or contraction due to the thermal diffusivity difference between the copper and the thermally insulting housing that may damage the injector. Additionally, the coil void in the injector body in which the coils are located may be larger than the physical space of the coils to allow for expansion of the coils.

The magnetic shield 124 on the outside of the outer part of the thermally insulating housing 140 is located radially outwards of the copper coils to absorb any stray magnetic field, inhibiting any interaction of a magnetic field with other components of the engine. To achieve this function, the magnetic shield 124 may be a material with appropriate magnetic properties, for example the magnetic shield may have a large magnetic permeability.

The outer part 141 of the thermally insulating housing 140 that surrounds the injector body is configured such that the main body of the injector is thermally insulated but the bottom portion of the injector (that surrounds the liquid coolant outlet 104 and the tip) is tapered to reduce the insulation of the tip of the injector and allow heating of the liquid coolant outlet 104. This heating may take the form of a temperature gradient along the bottom portion of the injector, for example along the longitudinal axis of the injector. For example, the tip of the injector may be warmest, and the injector cools as the distance along the injector in the longitudinal axis (towards the top portion) increases. The tapering of the injector and/or thermally insulating housing 140 may inhibit heat flow into the injector from all directions except from the liquid coolant outlet 104. This may be used for injectors that use a liquid coolant that is condensed into a liquid phase via refrigeration.

The configuration of the thermally insulating housing 140 limits the transfer of heat from outside the injector 100 into the liquid coolant flow path 118 of the injector 100. This limits the change in temperature between coolant flowing from a liquid coolant reservoir into the injector 100 through the liquid coolant inlet and coolant in the liquid coolant flow path 118 in the injector 100. The injector is used to inject liquid coolant into a cylinder of a split cycle engine, and so the tip of the injector may be inserted slightly into a cylinder of the engine. The tip of the injector will thus be exposed to the conditions in the cylinder and so consequently there will be some transfer of heat from the cylinder into the injector through the tip of the injector. The attachment of the injector to the cylinder so that the injector may inject into the cylinder may also place constraints on the shape of the bottom portion of the injector. Generally, as a result of this configuration, the only significant transfer of heat from outside the injector in to the liquid coolant flow path 118 occurs through the tip of the injector.

In embodiments where the injector is used for liquid coolants which have been condensed into a liquid phase via refrigeration, if the coolant is subject to much heating it may vaporise into a gas, which will significantly increase the pressure inside the injector. The configuration of the thermally insulating housing 140 of the injector 100 limits the transfer of heat to parts of the liquid coolant flow path 118 other than the tip of the injector, and so any heating and vaporising of coolant is confined to the portion of the liquid coolant flow path 118 proximal to the tip of the injector. As a result, the risk of over-pressurisation due to heating of the coolant in the liquid coolant flow path 118 is reduced, as is the risk of over-pressurisation due to heating of coolant in a liquid coolant reservoir connected to the liquid coolant inlet 102. Additionally, heat transfer through the tip of the injector reduces the risk of a build-up of frozen substances at the tip of the injector, which may otherwise prevent the injector from functioning normally (e.g. by clogging of the coolant outlet 104).

The operation of the example injector shown in FIGS. 1 and 2 will now be described by way of an example with reference to the method of operation shown in the flow chart of FIG. 4.

In FIG. 1 the liquid coolant flows into the injector 100 via the liquid coolant inlet 102. The liquid coolant may be in a low pressure system with a small pressure differential providing a driving means. Additionally, the liquid coolant may have been filtered prior to being received by the injector 100. During engine start up, the injector 100 will be at a higher temperature than the liquid coolant. Therefore, the initial flow of liquid coolant may act to cool the injector down, leading to vaporisation of a portion of the liquid coolant. This can be injected into a compression cylinder to enable quasi-isothermal compression to occur within the compression cylinder. As the liquid coolant fills the injector, it flows towards the liquid coolant outlet 104 where it is blocked by the valve closure member 106. The spring 110 is in constant contact with the moving part 131 of the driver 130 and provides a force that holds the valve closure member 106 in the first position.

A controller may operate elements of the injector; this may be in response to a signal received from a master controller that operates the split cycle engine and an example mode of operation is described in more detail with reference to FIG. 4 below. The injector operates before or during a compression stroke of the compression cylinder and injects a selected amount of liquid coolant into the cylinder in order to achieve quasi isothermal compression. In response to a control signal from the controller, a voltage is supplied to the coils of the injector by the controller. The resulting current in the coils induces a magnetic field within the injector, which in turn causes the magnet of the moving part 131 of the driver 130 to move in order to minimise the energy stored in the magnetic field.

As discussed below with reference to FIG. 4, the controller is configured to receive a signal indicative of a parameter of the driver 130 and to use this signal to determine the resistance of the driver 130. This enables the controller to determine the voltage to be applied to the coils. This voltage is chosen to generate a desired field, the desired field resulting in a desired movement of the magnet of the moving part 131 of the driver 130. As the temperature of the injector 100 varies, so does the resistance of the coils. Thus, applying one voltage to the coils could result in a variety of different currents being generated depending on the temperature of the coils. Therefore, the controller is operable to determine the desired voltage to be applied to prevent undesirable movements of the valve closure member 106, and to control the voltage applied accordingly. For example, undesirable movements of the valve closure member 106 may comprise: applying insufficient voltage to move the valve closure member into a desired location, or applying too much voltage and the resulting movement of the valve closure member causing damage.

The spring 110 provides a bias to the valve closure member 106 along the longitudinal axis of the injector 100, in alignment with the liquid coolant flow path 118. This bias is in the direction of the liquid coolant outlet 104. Thus, movement of the valve closure member 106 and the moving part 131 of the driver 130 in the opposite direction, i.e. towards the liquid coolant inlet 102, is opposed to by the spring 110. In response to a sufficient magnetic field being generated by the coils to overcome the bias of the spring, the moving part 131 of the driver 130 and the valve closure member 106 move towards the spring 110, and lose contact with the insulating housing surrounding the liquid coolant outlet 104. In this state, the valve closure member 106 is in the second position. This state is shown in FIG. 2.

FIG. 2 shows the injector of FIG. 1 with the valve closure member 106 in the second position. In the second position, the liquid coolant may flow from the liquid coolant inlet 102 and out of the liquid coolant outlet 104. The injector is therefore in a state where the liquid coolant is allowed to flow or be injected into an engine cylinder.

In FIG. 2 a current is flowing through the coils of the actuating part 132 of the driver 130, causing a magnetic field to be generated within the injector 100. The magnet, which forms part of the driver 130 and which is mechanically coupled to the valve closure member 106, moves against the spring 110 to minimise the energy stored in the magnetic field. This causes the valve closure member 106 to be pulled towards the liquid coolant inlet 102, and away from the liquid coolant inlet 102, breaking the seal at the liquid coolant outlet 104. This allows liquid coolant to flow along the liquid coolant flow path 118 and out of the liquid coolant outlet 104.

The current in the coils can be maintained depending on the control signal from the controller. This can be chosen depending on how much liquid coolant needs to be injected. Once the current is stopped the valve closure member 106 is driven into the first position by the spring 110, preventing additional liquid coolant from being injected into the compression cylinder. This cycle can be repeated for every compression stroke of the compression cylinder.

While the coils in the described embodiment are composed of copper, it is clear to the skilled person that alternative materials could be used instead such as aluminium, iron or other electrically conductive materials. Copper is preferable due to its high conductivity and the ease of which copper coils can be manufactured.

The selection of material for the injector is an important consideration due to the large thermal range at which the injector may have to operate. These considerations have led to the material selection being based on the thermal diffusivity and bulk moduli of materials. The injector is likely to operate between ambient temperatures and temperatures of the liquid coolant, these lower temperatures could be for example 77 K for liquid nitrogen, or liquefied air. The difference in temperature between the liquid the injector is injecting and the surrounding environment (particularly the temperature of the compressed working fluid in the compression cylinder) can lead to expansion and contraction of materials by an amount dependent on the bulk modulus of the material. It may therefore be desirable to have a similar thermal expansion coefficient for all materials/components of the injector.

Additionally, the cycling of the injector between ambient temperature and low temperatures could lead to a variation in speed of contractions and expansions of components. Again it may therefore be desirable that materials/components of the injector have similar thermal diffusivities to ensure that these expansions and contractions are not significantly mismatched, and to avoid differential thermal expansion.

The magnetic shield 124 of the injector inhibits any magnetic fields produced within the injector, for example by the copper coils of the driver 130 from interacting with the environment external to the injector. In operation this may include other injectors or engine components that are disposed close to the injector. The magnetic shielding 124 may have a high magnetic permeability such that the magnetic flux is concentrated through the shielding rather than extending outside of it. As the magnetic shielding 124 is disposed on the outside of the outer part 141 of the thermally insulating housing 140, the thermal properties of the material used in the magnetic shielding 124 are not as important as materials within the injector body. This means materials such as soft iron may be preferred for the magnetic shielding 124 due to their high magnetic permeability.

In some embodiments, the liquid coolant may be a non-combustible liquid that has been condensed to a liquid phase via refrigeration, for example liquefied air, liquid nitrogen, liquid oxygen or liquefied natural gas. In the case of these cryogenic liquid coolants, the problem of lubricating injectors is an important consideration. Traditional lubricants are prone to solidifying at such low temperatures and the self-lubricating capability of liquid coolants such as liquid nitrogen may not be sufficient to lubricate the injector. The surfaces of the injector that may come into contact with liquid coolant may therefore be coated with material such as diamond-like coating (DLC). This layer is optimally a thin film such that it inherits the thermal expansion properties of the injector body material, such as the thermal expansion coefficient.

The temperatures of the above-mentioned liquid coolants are significantly different to ambient temperatures such as standard temperature and pressure (273 k at 100 kPa). For example, liquid nitrogen may be used as the coolant. The boiling point of liquid nitrogen is 77K and so the operational temperatures of the liquid coolant injector when using liquid nitrogen as the coolant will be 77K or less. Although it is noted that the injector is operable at significantly higher temperatures. For example, during start up of an engine, the liquid coolant flow path will not have received a flow of liquid coolant and may have warmed to ambient temperatures. The flow chart shown in FIG. 4, and discussed in more detail below, comprises a method of determining the resistance of the driver 130 (which will vary with the variations in temperature). This enables the injector to compensate for these differences in temperature, and limit the effect these differences may have on the movement of the valve closure member.

While the coils of the actuating part 131 of the driver 130 in FIG. 1 comprise copper, this is not a requirement for the injector. The coils could comprise any electrically conductive material that is stable at low temperatures, such as iron, aluminium or an alloy of metals.

As noted above, the selection of this material may also be based on the thermal expansion coefficients and thermal diffusivity of the materials of the thermally insulating housing 140 or injector body. If the materials have very similar thermal diffusivities and thermal expansion coefficients then the resin matrix and coil voids 122 to contain the coils may not be required.

Embodiments where the driver 130 does not comprise coils of electrically conducting materials in the injector body are also envisaged. For example, the driver 130 may comprise a magnetic coupling and a lever configured to move the valve closure member 106. For instance, the lever may be coupled to the valve closure member 106 such that movement of the lever causes the valve closure member 106 to move. A controlled magnet arrangement may then be used to move the lever and thus control the position of the valve closure member 106. For example, the lever may be configured to pivot about a pivot point such that the rotation of the lever from a first angle to a second angle causes the valve closure member 106 to move from the first position to the second position. The magnet arrangement may comprise a first magnet, or other suitable biasing mechanism, configured to retain the lever at the first angle. The magnet arrangement may also comprise a second magnet, which may be actuated to produce a greater force than the retaining force of the first magnet, and thus upon actuation of the second magnet the lever is driven to the second angle. In embodiments where one of the magnetic elements of the driver 130 is mechanically coupled to the valve closure member 106, either or both of the magnetic elements may be electromagnets.

In FIG. 1 the biasing member 110 comprises a spring 110. The skilled person will of course understand that other compressible or elastic materials and structures could be used instead to provide a biasing means. As an example, Belleville washers may be used, as could a torsion spring or a pneumatic buffer such as an accumulator. Additionally, the valve closure member could be weighted and held in place under the force of gravity.

In some embodiments, the inner part 142 of the thermally insulating housing 140 may form the injector body. In other embodiments, the injector body may be a separate component to the inner part 142 of the thermally insulating housing 140, and the injector body may comprise austenitic steel or carbon fibre. The use of carbon fibre in the injector body may be preferable due to its thermal properties and light-weight nature. When the injector body is a stainless steel material, the injector body may further comprise a thermally insulating layer to prevent liquid coolant within the liquid coolant flow path 118 from being vaporised.

In some examples, the injector 100 may not have a separate layer of thermally insulating housing 140. In such examples, the body of the injector may therefore form the thermally insulating housing of the injector. The body of the injector may comprise an insulating void 120 to increase the thermal insulation of the injector. In examples with a separate layer of thermally insulating housing, the layer of thermally insulating housing may comprise an insulating void. Such insulating voids 120, whether in the housing of the injector or the thermally insulating housing, can be filled with a material that is a gas at ambient, atmospheric temperatures. When cooled to operational temperatures, such as those close to the boiling point of the liquid coolant, this gas can undergo a phase change to create a low pressure environment in the insulating voids 120, providing improved thermal insulation. In the case of liquid nitrogen as the liquid coolant, the operational temperatures would be 77K and lower. Therefore filling the insulating voids 120 with carbon dioxide at standard temperature and pressure will result in voids containing relatively small amounts of solid carbon dioxide and at a low pressure. This is because the volume of the insulating voids will remain largely the same whether at room temperature or at operational temperatures. However, once the carbon dioxide is cooled to operational temperatures of the injector, such as 77K or lower, it will contract and freeze forming a solid, at around 195K, which will thus take up significantly less volume in the insulating void 120. This leads to the insulating void 120 being at a very low pressure.

Figure 3:
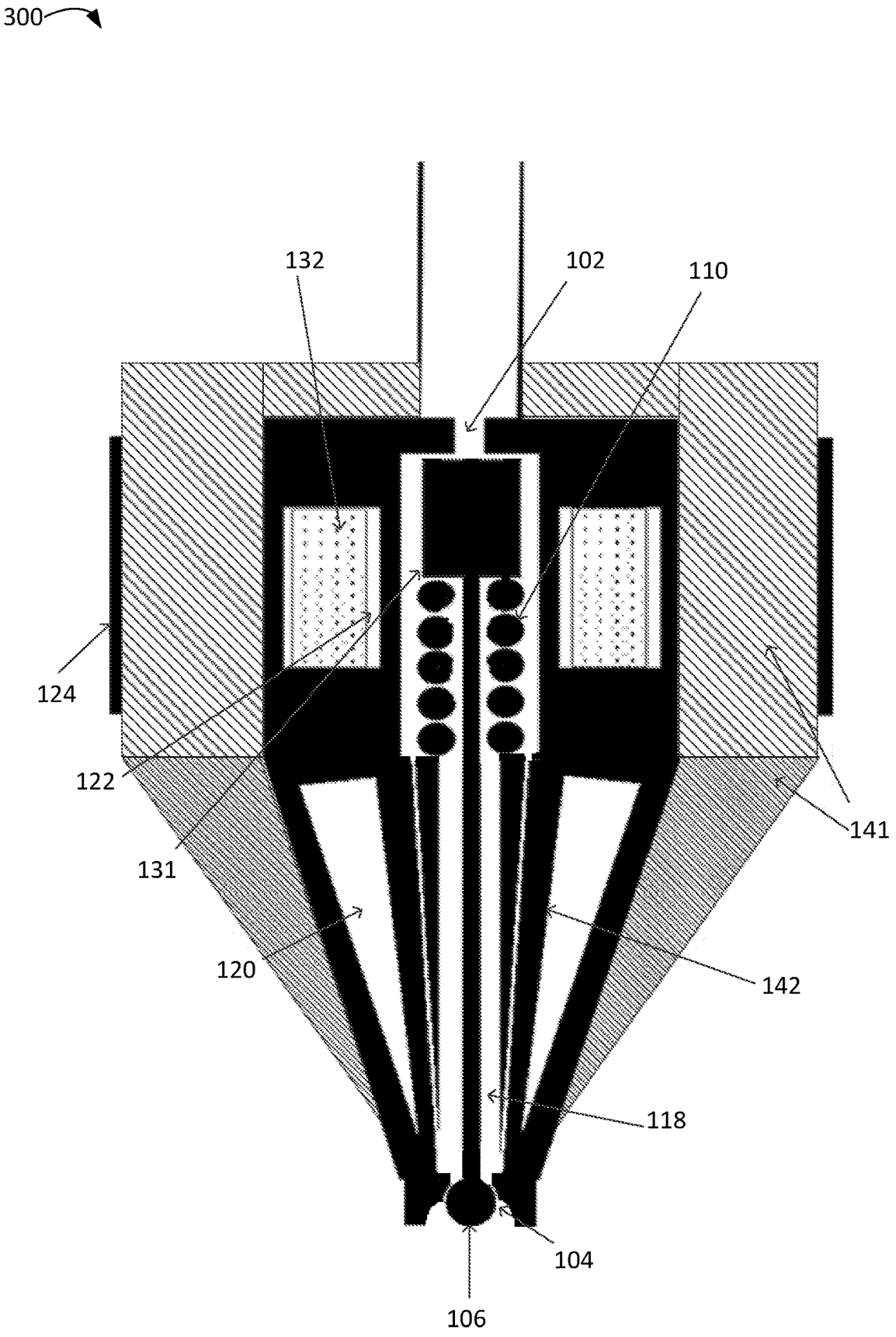
FIG. 3 shows a cross section of an example second liquid coolant injector.

In some examples the injector may have a different configuration. FIG. 3 shows an example liquid coolant injector 300 with a similar design to the injectors shown in FIGS. 1 and 2 but with a different arrangement for the valve closure member 106. In the example shown in FIG. 3, the valve closure member 106 opens outwards from the injector body when moving from the first position to the second position. This means that the valve closure member 106 moves away from both the liquid coolant outlet 104 and the liquid coolant inlet 102 when the liquid coolant is allowed to flow from the liquid coolant outlet 104. This may be a preferred arrangement of the valve closure member 106 as a pressure build up in the liquid coolant flow path 118, due to vaporisation of an amount of the liquid coolant, exerts a force on the valve closure member 106. This force can overcome the biasing of the spring 110 and therefore allow the higher pressure coolant to be vented into the compression cylinder, preventing a potentially dangerous build-up of pressure within the liquid coolant injection system.

To implement these differences in the injector, in the example shown in FIG. 3 the magnet of the driver 130 and the biasing member 110 have been rearranged such that the biasing member 110 acts to maintain the valve closure member 106 in the first position. The moving part 131 and the actuating part 132 of the driver 130 have been rearranged to ensure that the driver 130 can move the valve closure member 106 between the first and second position.

The liquid coolant injector is suitable to be connected to a liquid coolant system which may comprise a reservoir, a means to drive the liquid coolant from the reservoir to the injector. A system of this type may also use a filter between the liquid coolant reservoir and liquid coolant injector to remove solid containments.

A method for controlling the injection of the coolant will now be described with reference to FIG. 4.

Figure 4:
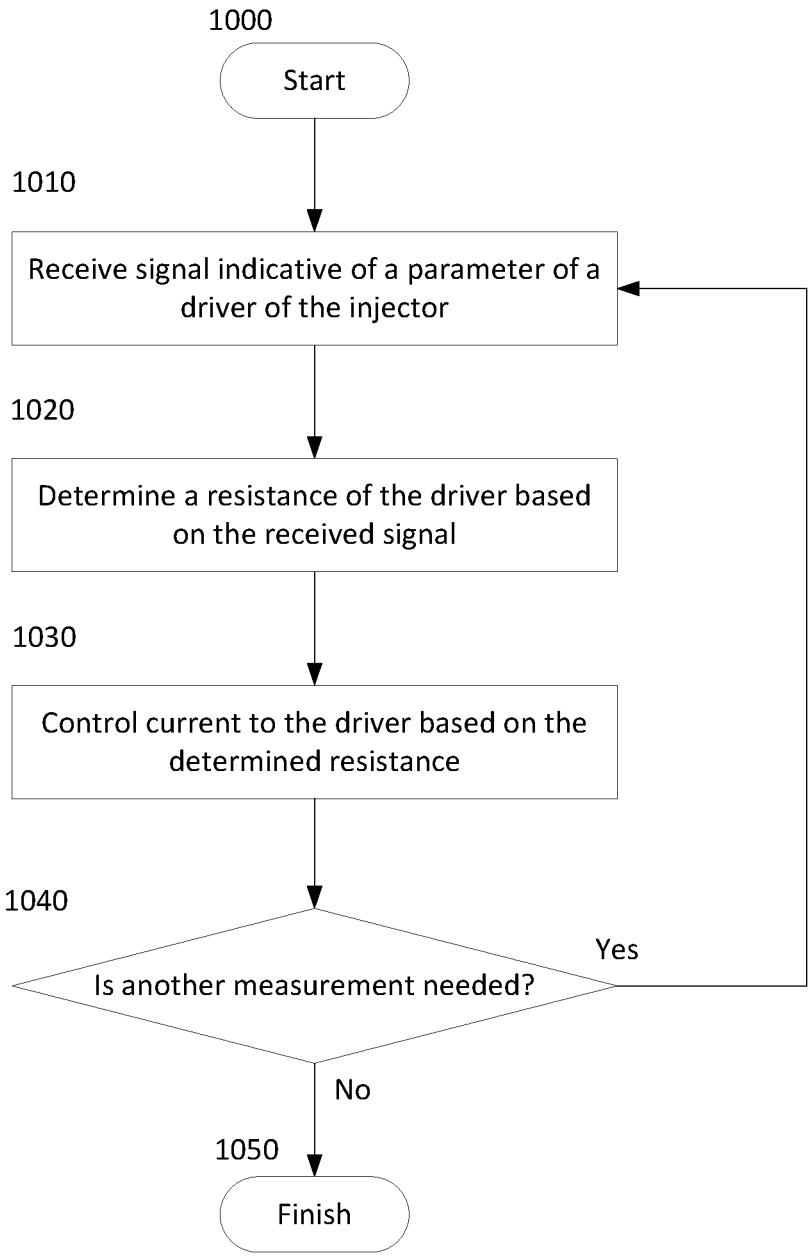
FIG. 4 shows a flow chart for a method of operation of an example liquid coolant injector.

FIG. 4 shows a flow chart for the method of controlling the injection of liquid coolant, for example for use with the injector of any of FIGS. 1 to 3. At step 1000 the method starts, and at step 1010 a signal indicative of a parameter of a driver 130 of the injector 100 is received. The received signal may be indicative of a resulting current which was measured in response to applying a selected voltage to the driver 130. At step 1020, the resistance of the driver 130 is determined based on the received signal. For example, where the received signal is indicative of a resulting current measured in response to apply a selected voltage to the driver 130, the resistance may be determined using Ohm's law (V=IR).

At step 1030 the current to the driver 130 is controlled based on the determined resistance. Controlling the current to the driver may comprise applying a voltage to the driver, wherein this voltage is selected based on the determined resistance to produce a selected current in the driver 130. This current is selected so as to move a valve closure member 106 of the injector 100 between a first position and a second position, wherein when in the second position the injector injects liquid coolant into the engine.

In embodiments, the driver 130 is magnetically coupled to the valve closure member 106. For example, the driver 130 may comprise a coil, and movement of the valve closure member 106 may be in response to a current being passed through the coil. A current being passed through the coil will generate a magnetic field having a strength in accordance with Ampère's law, which, due to the magnetic coupling, will cause a movement of the valve closure member 106. The strength of the magnetic field generated is proportional to the current passed through the coil, and so the movement of the valve closure member 106, will be dependent on current being passed through the coil. Additionally, the speed and acceleration of the movement of the valve closure member 106 will be proportional to the size of the current being passed through the coil.

The method shown in FIG. 4 is used to determine operating conditions for the valve closure member, wherein the operating conditions comprise the selected voltage to be applied to the driver 130. The operating conditions are determined because applying the same selected voltage to the coil will result in a different resulting current passing through the coils if the resistance of the coil changes. Consequently, the voltage required to be applied to the coil to move the valve closure member 106 to the second position will vary depending on the resistance of the coil. If too much voltage is applied, the resulting movement may damage the valve closure member 106, and if too little voltage is applied, then the valve closure member 106 may not move at all.

Changes in the resistance of the coil will occur when the temperature of the coil changes. The coil of the injector 100 may be located very close or adjacent to the flow path of cryogenic fluid, and so it may undergo significant changes in temperature in response to a change in the presence of a cryogenic fluid in the liquid coolant flow path 118. For example, when there is a constant supply of cryogenic fluid in the liquid coolant flow path 118, the temperature of the driver 130 will be very low. However, during start-up after a period of the driver 130 not being used, the driver 130 may have warmed up due to the lack of a constant flow of cryogenic fluid through the fluid flow path. This is because heat may be transferred into the injector 100 from the surroundings. In particular, the tip of the injector has no thermally insulating housing 140 protecting it, and so ambient heat may be transferred, from the cylinder of the engine, through the tip of the injector and along the liquid coolant flow path 118. The driver 130 is typically in close proximity to the liquid coolant flow path 118 and so heat transfer by conduction from heat in the liquid coolant flow path 118 may occur resulting in the driver 130 being heated. Consequently, the resistance of the driver 130 may have significantly increased. If the applied voltage is not selected accordingly, this may present issues in both example scenarios. For instance, a higher resistance than expected may prevent the injector from opening and a lower resistance than expected may lead to a rapid opening which may damage the valve closure member 106.

Controlling the current to the driver 130 comprises applying a voltage to the driver 130, where the voltage is selected based on the determined resistance to produce the selected current in the driver 103. The selected current is chosen based on the injector and the desired level of coolant to be injected. For instance, the following factors relating to the injector may have an influence on any movement of the valve closure member 106:

- The weight of the valve closure member 106 will dictate the size of the resulting force that is necessary for the valve closure member 106 to move into the second position;
- The amount of space it has to move into will dictate the maximum amount of force to be applied, because any more will likely damage the valve closure member 106 as it has nowhere to move into;
- A spring force of the spring 110 retaining it in position will dictate the minimum amount of force to be applied, because any less force than this will create insufficient compression of the spring for the valve closure member 106 to move into the second position;
- Number of turns of the coil 132 and the length of the coil will dictate, as per Ampère's law, the strength of the field generated, and hence of the force applied to move the valve closure member;
- Relative permeability of the magnetic path will also affect the force applied, as per Ampère's law;
- Viscosity of fluid through which the valve closure member 106 moves will influence the resistance of the movement of the valve closure member 106 through the liquid coolant flow path 118. Extra force will be required where the fluid is of a high viscosity.

Using these factors, it is possible to determine the voltage that should be applied to the coils to generate the required movement of the valve closure member 106. The required movement of the valve closure member 106 will typically be dictated by the volume of coolant to be injected into the cylinder. Coolant is generally only injected into the cylinder during the compression stroke and so there is a limited amount of time with which coolant can be injected per stroke. The volume of coolant injected will be proportional to the length of time for which the valve closure member 106 remains in the second position. If a large amount of coolant is to be injected then it may be desirable to open the valve closure member as quickly as possible. Therefore, it is possible to determine a desired trajectory for the valve closure member. This trajectory of the valve closure member 106 may comprise: the movement from the first position to the second position, a period of time remaining in the second position and moving back from the second position to the first position.

For each portion of this trajectory the above factors may be used when determining the voltage to be applied to the coils. The voltage applied to the coils, and thus the force applied to the valve closure member 106, may be time-varying, For example, the initial force may be larger because the valve closure member needs to accelerate. The fluid viscosity will affect the acceleration and so extra force will be required to overcome this. In the stationary state, a constant force will be applied which balances the bias of the spring, and in the closing phase, a small force may be applied to reduce the impact of the valve closure member returning to its seat at the tip of the injector. Another effect which may be considered may be the speed with which the valve closure member 106 moves in response to the current being passed through the coil. Therefore, the speed with which the injector 100 opens, and the distance it opens may be controlled entirely based on the selected current. Accordingly, to prevent damaging the valve closure member, the selected current may be limited so that the valve closure member moves from a first position to a second position, but does not move beyond the second position. The second position may therefore be chosen as one which will not bring the valve closure member 106 into contact with another surface.

These factors influence the movement of the valve closure member 106 once a force is applied to it. It is also preferable to determine the force that will be experienced by the valve closure member 106 in response to a current being passed through the coils. This may be determined using Ampère's law. The movement characteristics of the valve closure member 106 in response to each of a plurality of different currents being passed through the coil may be determined mathematically or empirically. The results may be stored, for example in a look-up table in a controller, which is either part of or connected to the injector. The method may comprise determining the amount of coolant to be injected, for example based on current engine conditions, and then determining a voltage to be applied to the coil, for example based on the look-up table, which will control the valve closure member 106 to following a suitable trajectory to result in the correct amount of coolant being injected.

In operation, the second position may be varied depending on the coolant injection requirements of the injector 100. For increased injection capacity the second position may be located further away from the first position and/or the speed with which the valve closure member 106 moves from the first position to the second position may be increased. It is to be understood in the context of this disclosure that once the valve closure member 106 is in the second position, controlling the current may comprise selecting a current designed to apply a magnetic field which retains the valve closure member 106 in a stationary state in the second location. Likewise, when the valve closure 106 member moves from the second position to the first this movement may be damped by passing a current through the coil. Accordingly, controlling the current to the driver 130 based on the determined resistance may comprise applying a series of different voltages to the driver 130 over a period of time to achieve a desired opening and closing of the injector, and thus a desired volume of fluid being injected into the engine.

In some examples, a step 1040 is included, at which point it is determined whether another measurement is needed. This step may be determined based on a present mode the injector is in. Two modes of operation may be defined for the injector: a normal mode and a variable mode. In the normal mode the flow of coolant through the liquid coolant flow path 118 is fairly constant and so the temperature of the driver 130 remains fairly constant. Accordingly, the resistance of the driver 130 need only be determined infrequently. Therefore, at step 1040, when in the normal mode of operation, another measurement is unlikely to be needed in quick succession. In the variable mode, the temperature of the injector may be changing. For example, there may be a known standard operational temperature of the injector, and until the injector has reached that temperature it is determined to be in the variable mode. When in the variable mode, the resistance of the driver 130 may change in a short space of time, in response to temperature changes of the driver 130. At step 1040, when in the variable mode, it may be determined that another measurement is needed to ensure that the force applied to the valve closure member 106 remains suitable.

As a result, in the initial stages of the engine running, the method may be in the variable mode which comprises continually or frequently determining the resistance of the driver and controlling the current accordingly. As the engine proceeds into routine operation, the method may be in the normal mode, and determining the resistance of the driver may not happen as frequently as it may be expected that the conditions in the injector and the engine will remain fairly constant. If it is determined that another measurement is needed, the method returns to step 1010 and the cycle is repeated. If it is determined that another measurement is not needed the method proceeds to step 1050 and finishes.

It is to be appreciated in the context of the present disclosure that at step 1010 the signal indicative of a parameter of a driver 130 of the engine does not have to be a measurement of current. In some embodiments, the signal may be indicative of a temperature of the driver 130, and as described below, the resistance of the driver may be inferred based on its temperature. It is to be appreciated that the steps 1010 and 1020 are configured so that the resistance of the driver 130 may be determined, and that this resistance is used to determine the voltage to apply to the coils, and thus to control the movement of the valve closure member 106. Accordingly, any other suitable measurements of the system and methods of determining the resistance of the driver 130 may be made. For example an Ohm meter may be used to directly measure the resistance, in which case the signal received at step 1010 will be indicative of the resistance of the driver 130, and so step 1020 may comprise using that resistance.

Figure 5:
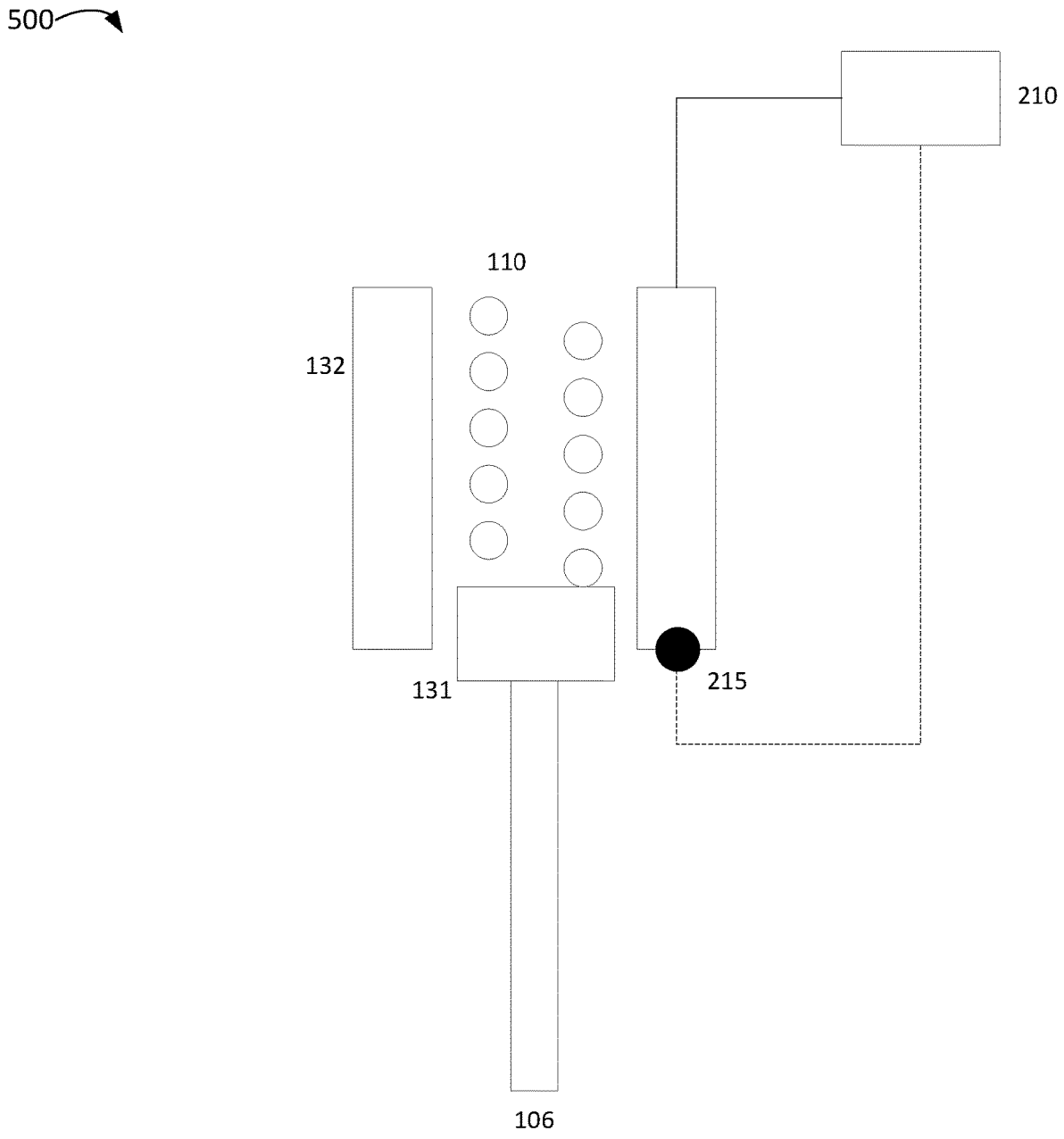
FIG. 5 shows a schematic diagram of a control system configured for use with an injector such as the example injector of FIGS. 1 to 3.

FIG. 5 shows a schematic diagram of a control system for the present injector. Like numerals are used to those used above when describing similar features of the injector. The injector 100 illustrated in FIG. 5 may be the example injector 100 of any of FIGS. 1 to 3.

The system 500 comprises a valve closure member 106, a driver 130, and a biasing member 110 which is illustrated as a spring. The driver 130 comprises a moving part 131 and an actuating part 132. Additionally, the control system comprises a controller 210 and a first sensor 215. The controller 210 is coupled to the driver 130 and connected to the first sensor 215. The valve closure member 106 is coupled at one end to the moving part of the driver 131, which is resiliently biased by the spring 110 to force the valve closure member 106 into the first position. The spring 110, the driver 130 and the valve closure member 106 are provided at least partially within the driver 130. In this embodiment, the actuating part 132 of the driver 130 comprises a coil, and the driver 130 is disposed along an axis which runs longitudinally through the coil.

The controller 210 may be part of the injector 500 or it may be separate to the injector 500. The controller 210 may be connected to the first sensor 215 and the actuating part 132 of the driver by any suitable means. For example, there may be a cable running between them, or the signal may be transmitted wirelessly. The remaining components of the injector 500 are housed within an injector body. The valve closure member 106 extends between the moving part 131 of the driver 130 and a tip of the injector. The moving part 131 of the driver 130 is biased into a first position by the spring 110. In the first position, the moving part 131 of the driver is disposed within the actuating part 132 of the driver 130, so that a generated magnetic field will cause the moving part 131 to move through the actuating part 132 to the second position, which is further away from the injector tip than the first position. The injector is largely symmetrical about its longitudinal axis, wherein the actuating part 132 of the driver 130 is annular and surrounds the longitudinal axis. The moving part 131 of the driver 130, the spring 110 and the valve closure member 106 are disposed along this longitudinal axis, and movement of the valve closure member 106 to the second position is along the longitudinal axis.

The coupling between the actuating part 132 of the driver 130 and the controller 210 is configured so that a voltage may be applied to the coil, e.g. from a battery, and the first sensor 215 is connected to the controller 210 so that it may send a signal to the controller 210 indicative of a measured parameter of the driver 130. For example, first sensor 215 may be an amp meter or any other suitable mechanism for measuring current, which is configured to send to the controller 210 an indication of a resulting current measured in response to a voltage being applied to the driver. Additionally, the driver 130 is magnetically coupled to the valve closure member 106 so that a current passing through the coil of the driver will result in movement of the valve closure member 106.

In operation, the controller 210 is configured to receive a signal indicative of a parameter of the driver from the first sensor 215. In response to receiving this signal the controller 210 is configured to determine the resistance of the driver 130. This resistance may be determined in the manner set out above in relation to the method of FIG. 4. The controller 210 is configured to control the current passed through the driver 130 based on the determined resistance, to move the valve closure member 106 from a first position to a second position. The signal indicative of a parameter of the driver may be indicative of a current. For instance, the controller 210 may apply a trial voltage to the driver 130, which results in a trial current being measured by the first sensor 215. The first sensor 215 may send a signal indicative of this current to the controller 210 which then determines the resistance of the driver 130. Accordingly, the controller 210 may then apply a voltage to the driver 130, the voltage being determined based on the determined resistance, to produce the desired current in the coil, so as to move the valve closure member 106 from the first position (for example as illustrated in FIG. 1) to the second position (for example as illustrated in FIG. 2).

Figure 6:
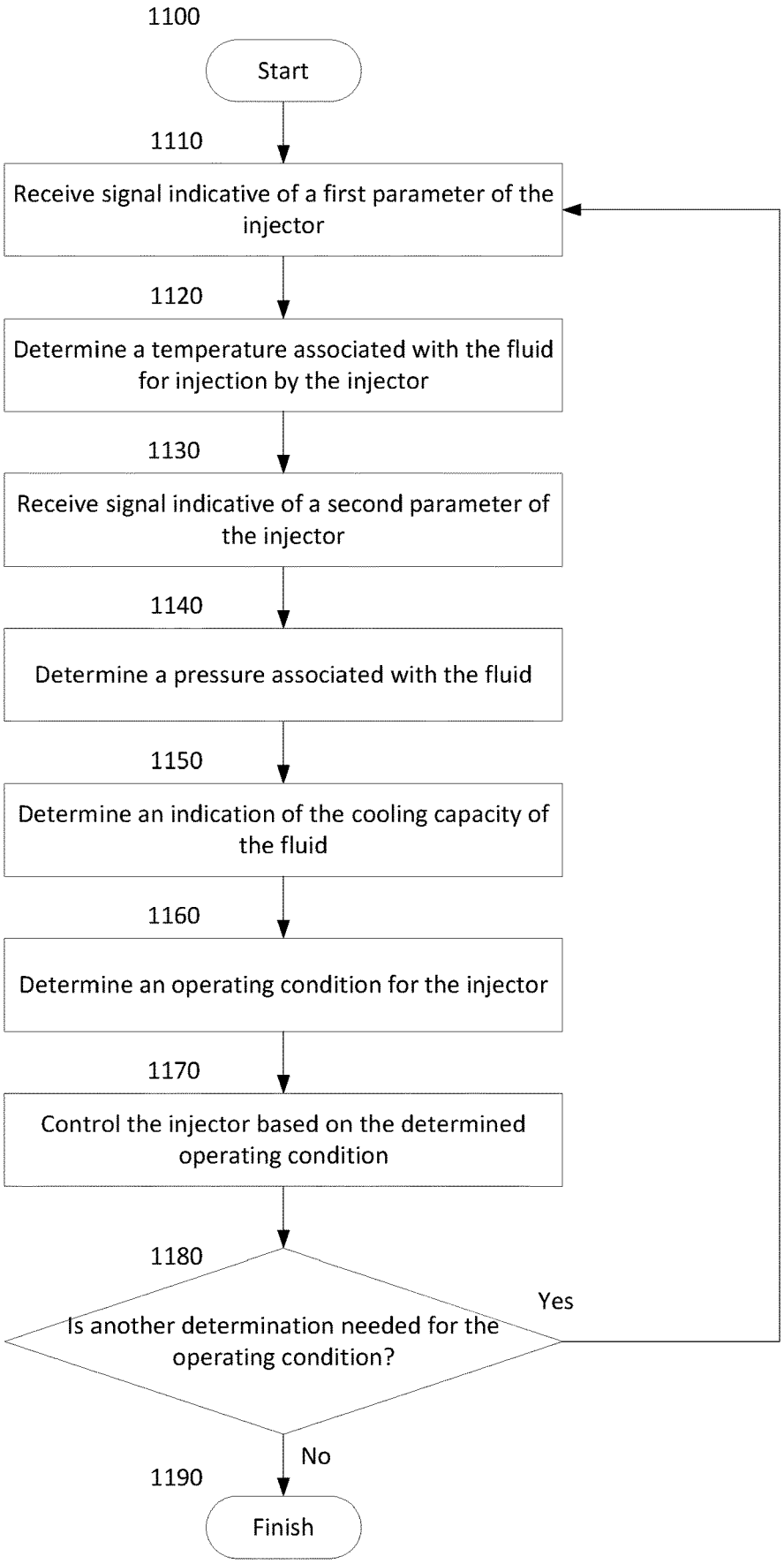
FIG. 6 shows a flow chart for a method of operation of a liquid coolant injector such as the example injector of FIGS. 1 to 3.

FIG. 6 shows a flow chart for a method of controlling the injection of liquid coolant, for example for use with the system illustrated in FIG. 5. At step 1100 the method starts and proceeds to step 1110 where a signal indicative of a first parameter associated with the fluid for injection by the injector is received. This signal may comprise a signal indicative of a first parameter associated with the injector itself, for instance, it may comprise a measurement of the resistance of an element of the injector 100, such as the coils. As described above with reference to FIG. 4, a signal comprising a measurement of the resistance may comprise a measurement of a resulting current measured in response to applying a voltage to the element of the injector.

The method may be used with any injector disclosed herein, and the resistance may be determined based on a measurement of the driver 130 of the injector. Where the driver 130 comprises a coil, the resistance of the coil is determined by applying a voltage to it and measuring the resulting current across it. Ohm's law still applies at low voltages and so only a small voltage has to be applied to the coil for its resistance to be determined in this way. This may preferable as determining the resistance using larger voltages, and thus larger currents being passed through the coil may cause undesired movements of the valve closure member of the injector.

At step 1120, in response to receiving the signal indicative of the first parameter, a temperature associated with the fluid for injection by the injector is determined. For example, where the signal comprises a measurement of the resistance of the coil, this resistance is used to determine the temperature of the coil. A temperature for the coil may be used as a reasonable approximation to the temperature of the coolant in the injector 100 as the coil will typically be in close proximity to the liquid coolant flow path 118. The temperature of the coil may be determined using Pouillet's law, as the resistance ("R") can be equated to the resistivity ("ρ"), the length of the material ("l") and its cross-sectional area ("A") by:

$$R = \frac{\rho l}{A}$$

The length and cross-sectional area will be known values and so Pouillet's law may be used to determine the resistivity of the coil. Resistivity has a known relationship with temperature, and thus can be used to deduce the temperature ("T"). For instance, when using the resistivity to determine the temperature, a linear approximation may be used so that the resistivity (ρ) is approximated by:

$$\rho(T)=\rho_0[1+\alpha(T-T_0)]$$

Where $\rho_0$ is the resistivity at a temperature $T_0$ (these are simply used as reference values), and α is a reference parameter. Accordingly, a temperature associated with the fluid for injection by the injector may be determined as a result of measuring the resistance of the coil. However, it is to be appreciated that any known method of determining a temperature for the coolant is considered to fall within the scope of the present disclosure, such as measuring the temperature directly using a thermometer.

At step 1130 a signal indicative of a second parameter associated with the fluid is received, and at step 1140 a pressure associated with the fluid is determined in response to receiving this signal. For instance, this signal may simply be received from a pressure sensor in the injector 100, but it is to be understood that the pressure of the coolant could be measured and/or determined in a number of ways. For example, a spring 110 in the injector 100 may be used as a measure of pressure, as the increased pressure may cause a change in the length of the compressed form of this spring 110.

At step 1150 an indication of the cooling capacity of the fluid is determined, which comprises determining the phase of the fluid based on the determined pressure and temperature of the coolant. In particular, it is to be determined whether the coolant is in a liquid phase or in a gaseous phase. This may be determined using data stored in a look-up table which links pressure, temperature and phase. The look-up table may be stored in a controller for controlling the injector, for example the controller may be the controller 210 shown in FIG. 5.

At step 1160 an operating condition of the injector is determined which comprises an operating condition for the coolant. The operating condition is determined based on the determined cooling capacity of the coolant, and may indicate an ability of the coolant to cool the working fluid in an engine cylinder. For instance, the specific heat capacity for a coolant may differ depending on which phase the coolant is in, and the operating condition of the coolant may reflect this. Typically, the specific heat capacity of a gas is less than that of its corresponding liquid, and when heating said liquid, extra heat may be absorbed based on the latent heat associated with the phase change from a liquid to a gas. Accordingly, the operating condition of a coolant is based on the temperature and phase of the coolant and thus may be used to determine a cooling effect per unit volume said coolant would have when used to cool the working fluid in the cylinder of an engine.

Determining the operating condition may comprise receiving a signal comprising an indication of an engine parameter, such as engine demand, and determining the operating condition based on this indication. This indication may be associated with the functioning of the engine itself. It may be representative of the thermodynamic conditions in a cylinder into which the injector is configured to inject coolant. For example, the indication may comprise details of an engine parameter such as a temperature or pressure of a working fluid in the engine. This may alter the ability of the coolant to cool, as the boiling point of the coolant is dependent upon its ambient pressure and so the phase of the coolant when in the cylinder, and thus its ability to cool, will be dependent upon the pressure in the cylinder. The operating condition may therefore reflect the ability of the coolant to cool air in the cylinder itself.

Where the engine is a split cycle internal combustion engine, this indication may represent a temperature of gas in a recuperator provided between the compression cylinder and combustion cylinder. It is to be appreciated that more than one engine parameter may be received and the use of the parameter may vary when determining the operating condition for the injector. For instance, an indication of engine demand may be received, which could enable future coolant requirements to be estimated.

At step 1170 the injector is controlled to deliver the fluid to an engine based on the determined operating condition. The coolant injection may be controlled to achieve a selected cooling effect based on the above-determination of the operating condition of the coolant and thus the cooling ability of the coolant. Therefore, the amount of coolant to be injected may be varied, which may be adjusted by retaining the valve closure member open in the second position for varying lengths of time. Where a certain requirement is set for the level of cooling to be achieved, it may be determined, based on the operating condition of the coolant, how much coolant needs to be injected to achieve this requirement for the level of cooling. In this way the overall cooling effect of the injected coolant may be tailored towards the demands of the engine.

At step 1180 it is decided whether another determination is needed for the operating condition. If yes, the method returns to step 1110 and if no the method proceeds to step 1190 where the method finishes. Step 1180 may comprise determining when a next determination is required. For instance, during start-up this may be a frequent occurrence, but during normal operation it may be less of a frequent occurrence.

As an example, an application of this method is now described in relation to several typical scenarios for an engine, and how the injector may be controlled in those scenarios.

During start-up of the engine, the requirement for the level of cooling may be different to that during normal operation because if the engine has not been running, it will be much colder than during normal operation. Accordingly, upon start-up the method may determine that it is preferable to avoid injecting too much coolant as the working fluid in the cylinder of the engine may already be cold enough, and thus no cooling will be required. This may be determined in relation to receiving a signal comprising an indication of an engine parameter. For example, where this engine parameter comprises a temperature it is possible to determine that the engine is in start-up mode or at least that the engine does not require any coolant at that time. In another example, a timer may be utilised so that it may be determined that the engine has only just started and so it is likely to be cold and thus less coolant is required.

As a consequence of the zeroth law of thermodynamics, the injector will tend towards a form of thermal equilibrium with its surroundings, which will generally be the cylinder of the engine due to the close proximity of the injector 100 with the compression cylinder. Due to the nature of the materials involved and the assembly of the injector with the engine cylinder, there will always be some form of thermal conduction through the outlet of the injector and along the liquid coolant flow path. During normal operation, this conduction does not spread so far as there is a constant supply of coolant along the liquid coolant flow path which keeps it cooler. However, when the engine is not running, this same flow of coolant does not occur and so over time some heat may progress along the liquid flow path. Accordingly, at start-up of the engine there may be a larger amount of gas present than usual, such as there being gas from the outlet all the way to the reservoir.

This build of gas rather than fluid in the liquid coolant flow path 118 of the injector 100 may be identified by the present method at step 1150, where the phase of the coolant in the injector may be determined to be a gas and the temperature higher than usual. The method may determine that during start-up the engine is cooler and thus less coolant is required. However, the method may still comprise initially controlling the injector to inject coolant as the gas inside the injector will be warmer, and thus will have less cooling effect. Accordingly, the injector may be able to 'clear-out' some of its contents without imparting a substantial cooling effect to the cylinder. This may then enable the injector to proceed into a state where regular operation may be promptly resumed when required, as the phase of the coolant in the injector may have returned to its normal region as the injection of the warmer air brings about more liquid coolant from the reservoir.

However, some gas may remain in the injector, and as the injector begins to operate, and thus the liquid coolant flow path experiences fluid flow from the reservoir, the phase of some of this gas may change as the liquid coolant causes some of the gaseous coolant to cool and condense. As described above, the liquid coolant may absorb substantially more heat than the gaseous coolant and thus it is important to know the phase of the coolant to determine the operating condition of the injector. Therefore, at step 1180, particularly during start-up, the phase determination may be repeated on a more frequent basis to ensure that the phase of the coolant is more precisely known.

During normal operation of the engine, a state of equilibrium may be reached where the phase as a whole remains fairly constant. For instance, during normal operation of the engine, the cylinder is likely to be at high temperatures and thus the liquid coolant outlet will be proximate to a large source of heat, and so some conduction is expected through the liquid coolant outlet 104 and along the liquid coolant flow path 118. This may give rise to localised pockets of coolants at a different phase, such as gas being found nearer the outlet and fluid being found further towards the inlet. This balance of gas and fluid may be consistent and so the cooling capacity of the coolant may not need to be determined very often.

Figure 7:
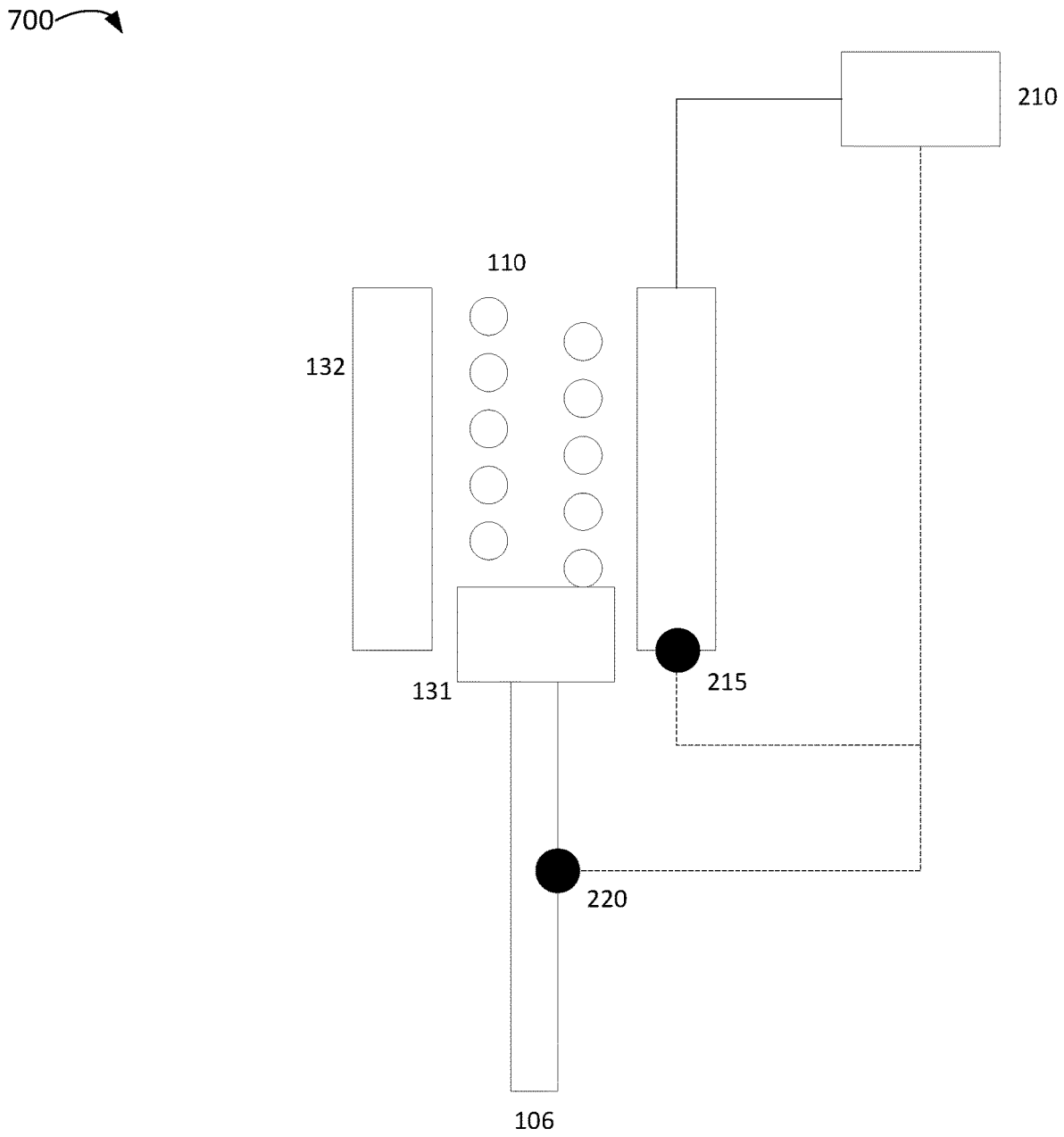
FIG. 7 shows a schematic diagram of a control system configured for use with an injector such as the example injector of FIGS. 1 to 3.

In some examples the control system described above in relation to FIG. 5 comprises a second sensor 220. The second sensor 220 may be connected to the controller 210 and is illustrated in the system 700 of FIG. 7 as being mounted on a part of the valve closure member 106. This illustration is purely exemplary. The second sensor 220 may be located anywhere within the injector or the engine as a whole as long as the second sensor 220 is configured to measure a parameter of the coolant, from which the controller 210 may determine the pressure of the coolant in the injector.

In operation, the controller 210 is configured to receive a first signal indicative of a first parameter of the injector from the first sensor 215. In response to receiving the first signal the controller 210 is configured to determine the temperature of the coolant in the injector. This temperature may be determined in the manner set out above, using measurements of resistance, as in relation to the method of FIG. 6. The controller 210 is also configured to receive a second signal indicative of a second parameter of the injector from the second sensor 220. In response to receiving the second signal, the controller 210 is configured to determine the pressure of the coolant in the injector. Based on these two determinations, the controller is configured to determine an indication of the cooling capacity of the fluid in the injector, which comprises determining the phase of the coolant, and to use this determined cooling capacity to determine an operating condition for the injector. The controller 210 is configured to control the movement of the valve closure member 106 to move from the first position to the second position, as described above in relation to the controller of FIG. 5, based on the determined operating condition.

The above methods may be implemented through the provision of the above-described controller which may be configured to perform the relevant method steps. Accordingly, the controller may be provided as part of the injector assembly. Alternatively, the controller configured to perform the above method steps may be provided as part of an engine assembly in which the injectors 100 are provided.

Although the above methods above have been described separately, it is to be understood that elements of both methods may be combined whilst remaining within the scope of the present disclosure. Whilst several methods of measuring or determining thermodynamic properties/parameters of the system have been described, this is not an exhaustive list. It is to be understood in the context of this disclosure that any suitable method for determining a desired property/parameter of the system may fall within the scope of the disclosure. For example, instead of using formulae to calculate a value, a look-up table may be used to equate one measurement or property with a corresponding other property or value, such as a link between a measured resistivity and its temperature.

With reference to the drawings in general, it will be appreciated that schematic functional block diagrams are used to indicate functionality of systems and apparatus described herein. It will be appreciated, however, that the functionality need not be divided in this way, and should not be taken to imply any particular structure of hardware other than that described and claimed below. The function of one or more of the elements shown in the drawings may be further subdivided, and/or distributed throughout apparatus of the disclosure. In some embodiments the function of one or more elements shown in the drawings may be integrated into a single functional unit.

In some examples, one or more memory elements can store data and/or program instructions used to implement the operations described herein. Embodiments of the disclosure provide tangible, non-transitory storage media comprising program instructions operable to program a processor to perform any one or more of the methods described and/or claimed herein and/or to provide data processing apparatus as described and/or claimed herein.

The activities and apparatus outlined herein may be implemented with fixed logic such as assemblies of logic gates or programmable logic such as software and/or computer program instructions executed by a processor. Other kinds of programmable logic include programmable processors, programmable digital logic (e.g., a field programmable gate array (FPGA), an erasable programmable read only memory (EPROM), an electrically erasable programmable read only memory (EEPROM)), an application specific integrated circuit, ASIC, or any other kind of digital logic, software, code, electronic instructions, flash memory, optical disks, CD-ROMs, DVD ROMs, magnetic or optical cards, other types of machine-readable mediums suitable for storing electronic instructions, or any suitable combination thereof.

It will be appreciated from the discussion above that the embodiments shown in the Figures are merely exemplary, and include features which may be generalised, removed or replaced as described herein and as set out in the claims. In the context of the present disclosure other examples and variations of the apparatus and methods described herein will be apparent to a person of skill in the art.

The invention claimed is:

1. A liquid coolant injector for injecting a liquid coolant into a cylinder of a split cycle engine, wherein the liquid coolant has been condensed into a liquid phase via a refrigeration process, the injector comprising:

a housing;

a liquid coolant inlet;

a liquid coolant outlet, wherein the liquid coolant inlet and the liquid coolant outlet are in fluid communication via a liquid coolant flow path and the liquid coolant flow path extends through the housing, the housing comprising at least one insulating void to thermally insulate the liquid coolant flow path;

a valve closure member, moveable between first and second positions, wherein the valve closure member blocks the liquid coolant flow path in the first position and allows the liquid coolant to flow from the liquid coolant inlet to the liquid coolant outlet when in the second position; and a driver operable to move the valve closure member between the first and second positions in response to a control signal, wherein the at least one insulating void contains a material that is in a gaseous phase at ambient temperature, and wherein the material is selected to undergo a phase change when cooled to an operational temperature to create a low pressure environment in the at least one insulating void, wherein ambient temperature is standard atmospheric temperature, and wherein an operational temperature comprises a temperature below or equal to the boiling point of the liquid coolant.

2. A liquid coolant injector for injecting a liquid coolant into a cylinder of a split cycle engine, wherein the liquid coolant has been condensed into a liquid phase via a refrigeration process, the injector comprising:

a thermally insulating housing;

a liquid coolant inlet;

a liquid coolant outlet in fluid communication with the liquid coolant inlet via a liquid coolant flow path wherein the liquid coolant flow path extends through the thermally insulating housing, the thermally insulating housing configured to inhibit vaporisation of the liquid coolant within the liquid coolant flow path;

a valve closure member, moveable between a first position in which the valve closure member blocks the liquid coolant flow path and a second position in which the liquid coolant may flow from the liquid coolant inlet to the liquid coolant outlet; and a driver operable to move the valve closure member between the first and second positions in response to a control signal, wherein the injector is configured such that the valve closure member acts as a pressure release valve when the liquid coolant vaporises in the liquid coolant flow path between the driver and the liquid coolant outlet.

3. The injector of claim 2 wherein the thermally insulating housing is configured to allow heating of the liquid coolant between the liquid coolant outlet and the driver.

4. The injector of claim 2 wherein the injector further comprises at least one insulating void configured to thermally insulate the liquid coolant flow path.

5. The injector of claim 1 wherein the at least one insulating void is between the driver and the liquid coolant outlet.

6. The injector of claim 1 wherein the at least one insulating void is arranged coaxially to the liquid coolant flow path.

7. The injector of claim 2 wherein the thermally insulating housing is configured to inhibit heating of the liquid coolant between the liquid coolant inlet and the driver.

8. The injector of claim 2 wherein the driver comprises a magnetic coupling.

9. The injector of claim 8 wherein the driver is operable to move the valve closure member between the first and second positions by application of a current to an electromagnet.

10. The injector of claim 9 wherein the driver comprises a coil of electrically conducting material located within the thermally insulating housing.

11. The injector of claim 10 wherein the coil is coupled to a controller that is operable to measure the resistance of the coil and determine a temperature of the coil based at least in part on the measured resistance.

12. The injector of claim 2 wherein the valve closure member is configured to move away from both the liquid coolant outlet and the liquid coolant inlet when moving from the first position to the second position.

13. The injector of claim 2 wherein the valve closure member is configured to move away from the liquid coolant outlet and towards the liquid coolant inlet when moving from the first position to the second position.

14. The injector of claim 2 wherein the injector further comprises a magnetic shield arranged to inhibit a magnetic field generated inside the liquid coolant injector interacting with an environment external to the liquid coolant injector.

15. The injector of claim 10 wherein the coil is within a matrix of a material that is different from the electrically conducting material of the coil and from a material of an injector body of the thermally insulating housing to alter the effective thermal expansion coefficient of the coil and wherein the coil is located within a void of the injector body to accommodate variations in rates of expansion and contraction of the coil.

16. The injector of claim 2 wherein the liquid coolant flow path is tapered such that the valve closure member is operable to move to the second position when pressure inside the injector exceeds a predetermined pressure threshold.

17. The injector of claim 2, further comprising:

a controller configured to control the opening of the valve closure member, the controller being configured to:

receive a signal indicative of a parameter of the driver;

in response to receiving the signal indicative of the parameter of the driver, determine a resistance of the driver based on the received signal; and control a current to the driver, based on the determined resistance, to move the valve closure member between the first position and the second position.

18. A controller configured to control the opening of a valve closure member of an injector configured to inject a liquid coolant into a cylinder of an engine, wherein the liquid coolant has been condensed into a liquid phase via a refrigeration process, the controller being configured to:

receive a signal indicative of a parameter of a driver of the injector;

in response to receiving the signal indicative of the parameter of the driver, determine a resistance of the driver based on the received signal; and control a current to the driver, based on the determined resistance, to move the valve closure member between a first position and a second position, wherein controlling the current to the driver comprises: determining a voltage to be applied to the driver based on the determined resistance, and applying said voltage to the driver to provide a selected current in the driver to move the valve closure member.

* * * * *